US009036845B2

(12) United States Patent
Rasmussen et al.

(10) Patent No.: US 9,036,845 B2
(45) Date of Patent: May 19, 2015

(54) EXTERNAL INPUT DEVICE FOR A HEARING AID

(71) Applicant: GN ReSound A/S, Ballerup (DK)

(72) Inventors: Kim Rasmussen, Ballerup (DK); Ivar Wolf Larsen, Kokkedal (DK)

(73) Assignee: GN RESOUND A/S, Ballerup (DK)

( * ) Notice: Subject to any disclaimer, the term of this patent is extended or adjusted under 35 U.S.C. 154(b) by 0 days.

(21) Appl. No.: 13/907,606

(22) Filed: May 31, 2013

(65) Prior Publication Data

US 2014/0355799 A1 Dec. 4, 2014

(30) Foreign Application Priority Data

May 29, 2013 (DK) ..... 2013 70296
May 29, 2013 (EP) ..... 13169738

(51) Int. Cl.
*H04R 25/00* (2006.01)

(52) U.S. Cl.
CPC ..... *H04R 25/554* (2013.01); *H04R 25/407* (2013.01); *H04R 25/405* (2013.01); *H04R 2225/61* (2013.01); *H04R 25/43* (2013.01)

(58) Field of Classification Search
CPC .... H04R 25/40; H04R 25/402; H04R 25/405; H04R 25/407; H04R 25/43; H04R 25/554; H04R 2225/41; H04R 2225/61
USPC ..... 381/312, 313, 315, 322, 324, 331; 379/52, 55.1
See application file for complete search history.

(56) References Cited

U.S. PATENT DOCUMENTS

| | | | | |
|---|---|---|---|---|
| 7,206,426 | B1 | 4/2007 | Julstrom et al. | |
| 7,397,926 | B1 * | 7/2008 | Frerking | 381/315 |
| 7,783,067 | B1 * | 8/2010 | Frerking et al. | 381/315 |
| 7,869,612 | B1 * | 1/2011 | Frerking | 381/315 |
| 7,912,237 | B2 | 3/2011 | Fischer | |
| 8,094,848 | B1 * | 1/2012 | Frerking et al. | 381/315 |
| 8,300,865 | B2 * | 10/2012 | Frerking et al. | 381/331 |
| 8,509,466 | B2 * | 8/2013 | Frerking | 381/315 |
| 8,630,431 | B2 * | 1/2014 | Gran | 381/313 |
| 2008/0101635 | A1 * | 5/2008 | Dijkstra et al. | 381/315 |
| 2010/0278366 | A1 * | 11/2010 | Biundo Lotito et al. | 381/315 |
| 2011/0058699 | A1 * | 3/2011 | Kilsgaard | 381/315 |
| 2011/0075872 | A1 * | 3/2011 | Frerking | 381/331 |

(Continued)

FOREIGN PATENT DOCUMENTS

| | | | |
|---|---|---|---|
| EP | 2 282 412 | A1 | 9/2011 |
| EP | 2 375 786 | A1 | 10/2011 |
| JP | 58-057899 | A | 6/1983 |

OTHER PUBLICATIONS

Extended European Search Report dated Nov. 8, 2013, for related EP Patent Application No. EP 13169738.5, 6 pages.

(Continued)

*Primary Examiner* — Amal Zenati
*Assistant Examiner* — Joshua A Kaufman
(74) *Attorney, Agent, or Firm* — Vista IP Law Group, LLP

(57) ABSTRACT

A system includes: an external input device having a housing accommodating at least two telecoils having different orientations with respect to the housing, and an orientation sensor configured for sensing an orientation of the housing; and a selector configured for controlling connection of one of the at least two telecoils to an input of a hearing aid based on the sensed orientation.

6 Claims, 3 Drawing Sheets

(56) References Cited

U.S. PATENT DOCUMENTS

| | | | | |
|---|---|---|---|---|
| 2011/0249841 | A1* | 10/2011 | Corti et al. | 381/315 |
| 2012/0321112 | A1* | 12/2012 | Schubert et al. | 381/312 |
| 2013/0034241 | A1 | 2/2013 | Pandey et al. | |
| 2013/0188813 | A1* | 7/2013 | Waldmann | 381/315 |
| 2014/0056451 | A1* | 2/2014 | El-Hoiydi et al. | 381/315 |

OTHER PUBLICATIONS

First Technical Examination Report and Search Report dated Dec. 11, 2013, for related Danish Patent Application No. PA 2013 70296, 6 pages.

First Technical Examination dated Jul. 10, 2014, for related DK Patent Application No. PA 2013 70296, 4 pages.

* cited by examiner

EXTERNAL INPUT DEVICE FOR A HEARING AID

RELATED APPLICATION DATA

This application claims priority to and the benefit of Danish patent application No. PA 2013 70296, filed on May 29, 2013, and European patent application No. 13169738.5, filed on May 29, 2013. The entire disclosures of both of the above applications are expressly incorporated by reference herein.

FIELD OF TECHNOLOGY

A new hearing aid system is provided with a hearing aid and an external input device configured for transmission of audio signals to the hearing aid.

BACKGROUND

Hearing impaired individuals often experience at least two distinct problems:

1) A hearing loss, which is an increase in hearing threshold level, and

2) A loss of ability to understand speech in noise in comparison with normal hearing individuals.

For most hearing impaired patients, the performance in speech-in-noise intelligibility tests is worse than for normal hearing people, even when the audibility of the incoming sounds is restored by amplification. Speech reception threshold (SRT) is a performance measure for the loss of ability to understand speech, and is defined as the signal-to-noise ratio required in a presented signal to achieve 50 percent correct word recognition in a hearing in noise test.

In order to compensate for hearing loss, today's digital hearing aids typically use multi-channel amplification and compression signal processing to restore audibility of sound for a hearing impaired individual. In this way, the patient's hearing ability is improved by making previously inaudible speech cues audible.

However, loss of ability to understand speech in noise, including speech in an environment with multiple speakers, remains a significant problem of most hearing aid users.

One tool available to a hearing aid user in order to increase the signal to noise ratio of speech originating from a specific speaker, is to equip the speaker in question with a microphone, often referred to as a spouse microphone, that picks up speech from the speaker in question with a high signal to noise ratio due to its proximity to the speaker. The spouse microphone converts the speech into a corresponding audio signal with a high signal to noise ratio and transmits the signal, preferably wirelessly, to the hearing aid for hearing loss compensation. In this way, a speech signal is provided to the user with a signal to noise ratio well above the SRT of the user in question.

Another way of increasing the signal to noise ratio of speech from a speaker that a hearing aid user desires to listen to, such as a speaker addressing a number of people in a public place, e.g. in a church, an auditorium, a theatre, a cinema, etc., or through a public address systems, such as in a railway station, an airport, a shopping mall, etc., is to use a telecoil to pick up audio signals transmitted with a varying magnetic field generated, e.g., by telephones, FM systems (with neck loops), and induction loop systems (also called "hearing loops"). In this way, sound may be transmitted to hearing aids with a high signal to noise ratio well above the SRT of the hearing aid users.

Telecoils are very sensitive to magnetic fields including magnetic fields inherently generated by other components in a hearing aid, e.g. the receiver, and therefore proper positioning of the telecoil in the hearing aid is critical for the resulting performance of telecoil reception of a desired magnetic field.

SUMMARY

Many hearing aids are manufactured without a telecoil for ease of design and reduction of cost. Instead, telecoils may be provided in an external input device that is configured for transmission of signals received by the telecoils to the hearing aid.

The external input device may be used with two or more distinct orientations of the housing: For example, the user of the device may wear the device attached to the clothing or around the neck with a first orientation of the housing, e.g. a vertical orientation, or the user may put the external input device on a table with a second orientation of the housing, e.g. with a horizontal orientation.

Thus, the external input device need be provided with at least two telecoils with different orientations with relation to the housing so that one of the at least two telecoils is positioned with an orientation for maximum reception sensitivity when the device is used with a first orientation of the housing, e.g. a vertical orientation; and another of the at least two telecoils is positioned with an orientation for maximum reception sensitivity when the device is used with a second orientation of the housing, e.g. a horizontal orientation.

Desirably, the appropriate one of the at least two telecoils may be automatically selected for transmission of signals to the input of the hearing aid.

Thus, a hearing aid system is provided, comprising a hearing aid with an input connected to an external input device having a housing accommodating at least two telecoils accommodated with different orientations in the housing, and an orientation sensor configured for sensing orientation of the housing, and a selector configured for controlling connection of one of the at least two telecoils to the input of the hearing aid in response to the sensed orientation.

Likewise, a method of receiving a signal transmitted with a magnetic field is provided, comprising the steps of:

Accommodating at least two telecoils with different orientations for reception of the magnetic field in a device, accommodating an orientation sensor configured for sensing orientation of the device, and in response to the sensed orientation of the device, selecting one of the telecoils for supplying an output of the device induced by the magnetic field.

The orientation sensor may be an accelerometer, a gyroscope, a roll ball switch, etc.

For example, when the external input device is worn by a person, e.g. the user of the hearing aid system, with a vertical orientation of the housing, a first telecoil of the at least two telecoils, with an orientation providing maximum reception sensitivity of a hearing loop magnetic field when the housing has a vertical orientation, may be selected for provision of an input signal for the hearing aid. The first telecoil may be selected in both vertical orientations of the housing, i.e. in a first vertical orientation and turned upside down 180° into a second vertical orientation of the housing.

Further, the user of the hearing aid system may prefer to position the external input device on a proximate horizontal surface, such as a table in front of the user, with a horizontal orientation of the housing. With the horizontal orientation, a second telecoil of the at least two telecoils, with an orientation providing maximum reception sensitivity of the hearing loop magnetic field when the housing has a horizontal orientation, may be selected for provision of an input signal to the hearing aid. The second telecoil may be selected in both horizontal orientations of the housing, i.e. in a first horizontal orientation and turned upside down 180° into a second horizontal orientation of the housing.

The external input device may further comprise at least one microphone, e.g. one omni-directional microphone, for provision of a speech signal with high signal-to-noise ratio, when a person, the user desires to listen to, wears the external input device, e.g. by clipping the external input device onto the speaker's clothing, typically with a distance of 10 cm to 20 cm to the speaker's mouth. The at least one microphone of the external device will receive speech from the speaker with a high signal-to-noise ratio due to its proximity to the mouth of the speaker. Thus, when an external input device with at least one microphone is worn in the first vertical orientation of the housing, the at least one microphone may be selected for provision of the input signal to the hearing aid, and worn with the second and opposite vertical orientation, i.e. turned upside down 180° with relation to the first vertical orientation, the first telecoil with maximum reception sensitivity of a hearing loop magnetic field with a vertical orientation of the housing, may be selected for provision of the input signal to the hearing aid.

The external input device may further comprise at least two spaced apart microphones, e.g. two spaced apart omni-directional microphones, and a beamformer configured for combining microphone output signals of the at least two spaced apart microphones into a directional microphone signal, e.g. with a cardioid shaped directional characteristic as is well-known in the art of hearing aids.

Preferably, the at least two microphones are positioned so that the combined microphone output signals form a directional pattern of reception sensitivity that has its maximum in an upward vertical direction, when the external input device is worn in its first vertical orientation, and thus pointing towards the speaker's mouth when worn by the speaker with the first vertical orientation of the housing. The directional microphone signal may then be selected as the input to the hearing aid when the external input device is worn with the first vertical orientation of the housing wherein the maximum direction of sensitivity points upwards. When the external input device is worn, e.g. by the user, in the second and opposite vertical orientation of the housing, i.e. turned upside down 180° with relation to the first vertical orientation, the first telecoil of the at least two telecoils, with an orientation providing maximum reception sensitivity of a hearing loop magnetic field, with a vertical orientation of the housing, may be selected for provision of the input signal to the hearing aid.

In a meeting, the user may prefer to place the external input device on a meeting table in a first horizontal orientation of the housing, whereby the at least one microphone may be selected for provision of the input signal to the hearing aid, and preferably with an omni-directional characteristic for equal reception of speech from all participants of the meeting. In situations where the external input device is positioned with the second and opposite horizontal orientation of the housing, e.g. turned 180° upside down with relation to the first horizontal orientation, the second telecoil of the at least two telecoils with maximum reception sensitivity of a vertical magnetic field when the housing has the horizontal orientation, may be selected for transmission of its output signal to the input of the hearing aid.

A system includes: an external input device having a housing accommodating at least two telecoils having different orientations with respect to the housing, and an orientation sensor configured for sensing an orientation of the housing; and a selector configured for controlling connection of one of the at least two telecoils to an input of a hearing aid based on the sensed orientation.

Optionally, the orientation sensor is selected from the group consisting of an accelerometer, a gyroscope, and a roll ball switch.

Optionally, the external input device further comprises at least one microphone.

Optionally, the at least one microphone comprises at least two spaced apart microphones, and a beamformer configured for combining microphone output signals of the at least two spaced apart microphones into a directional microphone signal.

Optionally, the selector is configured for controlling connection of the directional microphone signal to the input of the hearing aid when the housing of the external input device has a certain orientation.

Optionally, the selector is configured for controlling connection of a first telecoil of the at least two telecoils to the input of the hearing aid when the external input device has a first orientation.

Optionally, the selector is configured for controlling connection of a second telecoil of the at least two telecoils to the input of the hearing aid when the external input device has a second orientation.

Optionally, the external input device further comprises at least one microphone; and wherein the selector is configured for controlling connection of an output signal of the at least one microphone to the input of the hearing aid when the external input device has a third orientation.

Optionally, the system further includes a beam former for providing a directional microphone signal; wherein the selector is configured for controlling connection of the directional microphone signal to the input of the hearing aid when the external input device has a fourth orientation.

Optionally, the system further includes the hearing aid.

A method of receiving a signal transmitted with a magnetic field, includes: accommodating a plurality of telecoils with different orientations for reception of the magnetic field in a device; accommodating an orientation sensor configured for sensing orientation of the device; and based on the sensed orientation of the device, selecting one of the telecoils for supplying an output of the device induced by the magnetic field.

Optionally, the method further includes: accommodating at least one microphone in the device, and wherein the act of selecting comprises selecting one of the at least one microphone and the plurality of telecoils based on the sensed orientation of the device.

Other and further aspects and features will be evident from reading the following detailed description of the embodiments.

BRIEF DESCRIPTION OF THE DRAWINGS

The drawings illustrate the design and utility of embodiments, in which similar elements are referred to by common reference numerals. These drawings are not necessarily drawn to scale. In order to better appreciate how the above-recited and other advantages and objects are obtained, a more particular description of the embodiments will be rendered, which are illustrated in the accompanying drawings. These drawings depict only exemplary embodiments and are not therefore to be considered limiting to the scope of the claims.

DETAILED DESCRIPTION OF THE DRAWINGS

Figure 1:
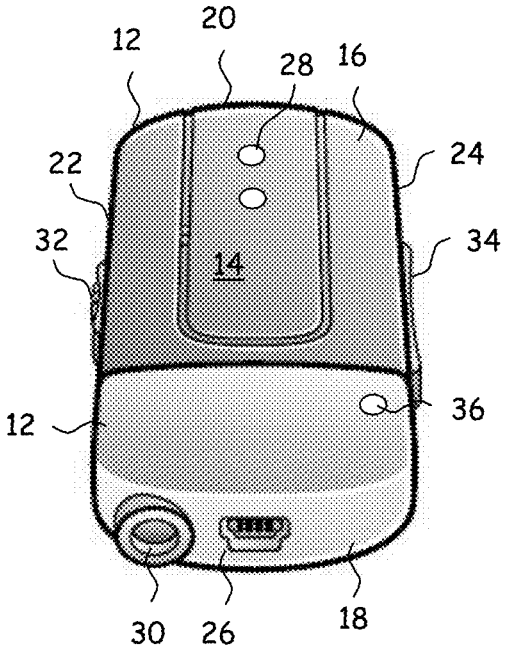
FIG. 1 shows an example of the new external input device in perspective.

Various embodiments are described hereinafter with reference to the figures. It should be noted that the figures are not necessarily drawn to scale and that elements of similar structures or functions are represented by like reference numerals throughout the figures. It should also be noted that the figures are only intended to facilitate the description of the embodiments. They are not intended as an exhaustive description of the invention or as a limitation on the scope of the invention. The claimed invention may be embodied in different forms and should not be construed as limited to the embodiments set forth herein. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

The new method and hearing aid system will now be described more fully hereinafter with reference to the accompanying drawings, in which various examples of the new method and hearing aid system are illustrated. The new method and hearing aid system according to the appended claims may, however, be embodied in different forms and should not be construed as limited to the examples set forth herein.

It should be noted that the accompanying drawings are schematic and simplified for clarity, and they merely show details which are essential to the understanding of the new method and hearing aid system, while other details have been left out.

Like reference numerals refer to like elements throughout. Like elements will, thus, not be described in detail with respect to the description of each figure.

FIG. 1 shows in perspective an external input device 12 of the new hearing aid system as viewed from a position in front of and slightly above the device 12.

The illustrated external input device 12 has a housing 14 having the approximate size of a lighter. The housing 14 has a top side 16, a bottom side (not visible) opposite the top side 16, a front side 18, a rear side 20 opposite the front side 18, a left side 22, and a right side 24 opposite the left side 22.

The external input device 12 is intended to enable users of the new hearing aid system to better understand speech, or to listen to other audio signals. The device 12 is configured to transfer signals from a microphone (not visible) or telecoil (not visible) accommodated within the housing 14 of the device 12, or other audio devices, to a wireless hearing aid. The external input device 12 has a mini-USB connector 26 for charging a rechargeable battery (not visible) of the external input device 12. Further, the external input device 12 has microphone input ports 28 located on the top side 16 of the housing 14, and a mini-jack connector 30 for connection with an audio device, such as a media player, a teleconference system, a radio, a TV, a telephone, etc, for streaming of their output audio signal to the hearing aid.

An on/off switch 32 is positioned on the left side 22 of the housing 14 and a volume control 34 is positioned on the right side 24 of the housing 14. A pairing button 36 resides on the top side 16 of the housing 14 enabling the user to pair the external input device 12 with the hearing aid (not shown).

The external input device 12 also has a clip (not visible) on the bottom side of the housing 14 so that the device 12 can be attached to the user's or a speaker's clothing, preferably with a vertical orientation, i.e. the housing 14 is attached to the clothing so that the top side 16, left side 22, and right side 24 have a substantially vertical orientation, while the front side 18 and rear side 20 have a substantially horizontal orientation.

The illustrated external input device 12 accommodates two telecoils inside the housing 14, one of which has an orientation providing maximum reception sensitivity of a magnetic field emitted by an induction loop system, i.e. a so-called "hearing loop", when the external device 12 is positioned with a horizontal orientation, i.e. the top side 16 has a substantially horizontal orientation, and the other of which has an orientation providing maximum reception sensitivity of a magnetic field emitted by an induction loop system, when the external device 12 has a vertical orientation in which the front side 18 and rear side 20 have substantially horizontal orientations.

An orientation sensor, in the illustrated external input device 12 in the form of a three-axis MEMS-accelerometer sensing gravity, accommodated in the housing 14 is configured for sensing orientation of the housing, and in particular configured for sensing when the external input device 12 is has a substantially horizontal orientation and a substantially vertical orientation, i.e. two axes of the three-axis accelerometer are aligned with gravity when the housing has the horizontal and vertical orientation, respectively.

The external input device 12 has two spaced apart omni-directional microphones with input ports 28, and a beamformer configured for combining omni-directional microphone output signals of the at least two spaced apart microphones into a signal with a directional characteristic with a maximum direction of sensitivity pointing towards the rear side 20 and thus, towards the mouth of a speaker wearing the external input device in a vertical orientation with the rear side 20 facing upward.

A selector accommodated in the housing 14 is configured for controlling wireless connection of output signals of the telecoils and the microphones to the input of the hearing aid in response to the sensor signals of the three-axis accelerometer. In the illustrated external input device 12, the selector is configured for selecting appropriate output signals in 4 distinct orientations of the external input device 12, namely 1) a first horizontal orientation in which the top side 16 with the microphone input ports 28 is substantially horizontal and facing upward, 2) a second horizontal orientation in which the top side 16 is substantially horizontal and facing downward, 3) a first vertical orientation in which the top side 16 and the right and left sides 22, 24 are substantially vertical with the horizontal rear side 20 facing upward, and 4) a second vertical orientation in which the top side 16 and the right and left sides 22, 24 are substantially vertical with the horizontal front side 18 facing upward.

With the first horizontal orientation, the selector controls connection of a microphone audio signal with an omni-directional characteristic to the input of the hearing aid.

With the second horizontal orientation, the selector controls connection of the output of telecoil with an orientation providing maximum reception sensitivity of a magnetic field from a hearing loop, to the input of the hearing aid.

With the first vertical orientation, the selector controls connection of the output of the beamformer with the directional characteristic to the input of the hearing aid.

With the second vertical orientation, the selector controls connection of the telecoil with an orientation providing maximum reception sensitivity of a magnetic field from a hearing loop, to the input of the hearing aid.

Figure 2:
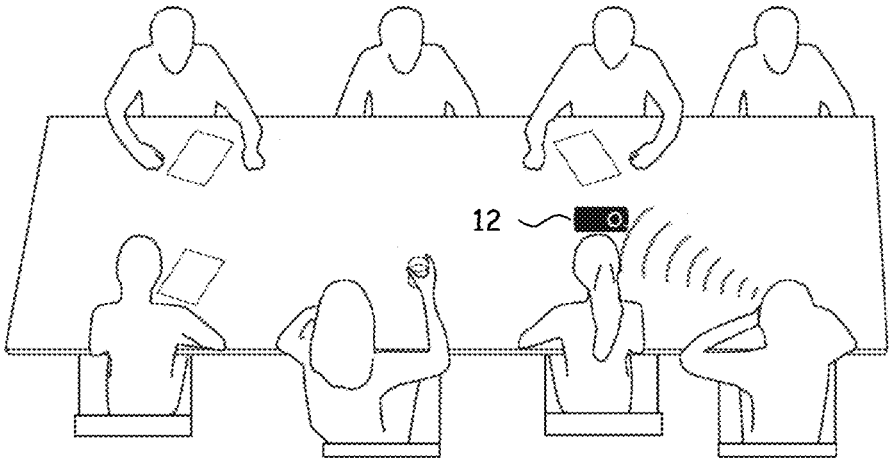
FIG. 2 schematically illustrates use of the new external input device in a meeting.

FIG. 2 illustrates one user situation, in which the user of the new hearing aid system participates in a meeting and has put the external input device 12 on the meeting table with the first horizontal orientation in which the microphone input ports face upwards. With this orientation, a microphone audio signal with omni-directional characteristic is connected with the input of the hearing aid (not shown) worn by one of the meeting participants. The omni-directional characteristic ensures equally good reception of speech from all participants in the meeting.

In another situation, the user of the hearing aid system may be in a room with a hearing loop and the user may place the external input device in front of him on a horizontal surface with the second horizontal orientation, i.e. turned upside down with relation to the first orientation illustrated in FIG. 2, i.e. the top side 16 facing downward, whereby the telecoil orientated for maximum reception sensitivity of the magnetic field in the room is connected to the input of the hearing aid. Alternatively, the user of the hearing aid system may prefer to attach the external input device 12 to his or her clothes with the second vertical orientation with the horizontal front side 18 facing upward, whereby the telecoil orientated for maximum reception sensitivity of the magnetic field in the room is connected to the input of the hearing aid.

In yet another situation, the user may desire to listen to a specific speaker, e.g. a guide at an exhibition, in which case the user may attach the external input device 12 to the clothes of the guide with the first vertical orientation with the horizontal rear side 20 facing upward so that the maximum direction of sensitivity points towards the speaker's mouth, and the directional microphone output signal is connected to the input of the hearing aid.

Figure 3:
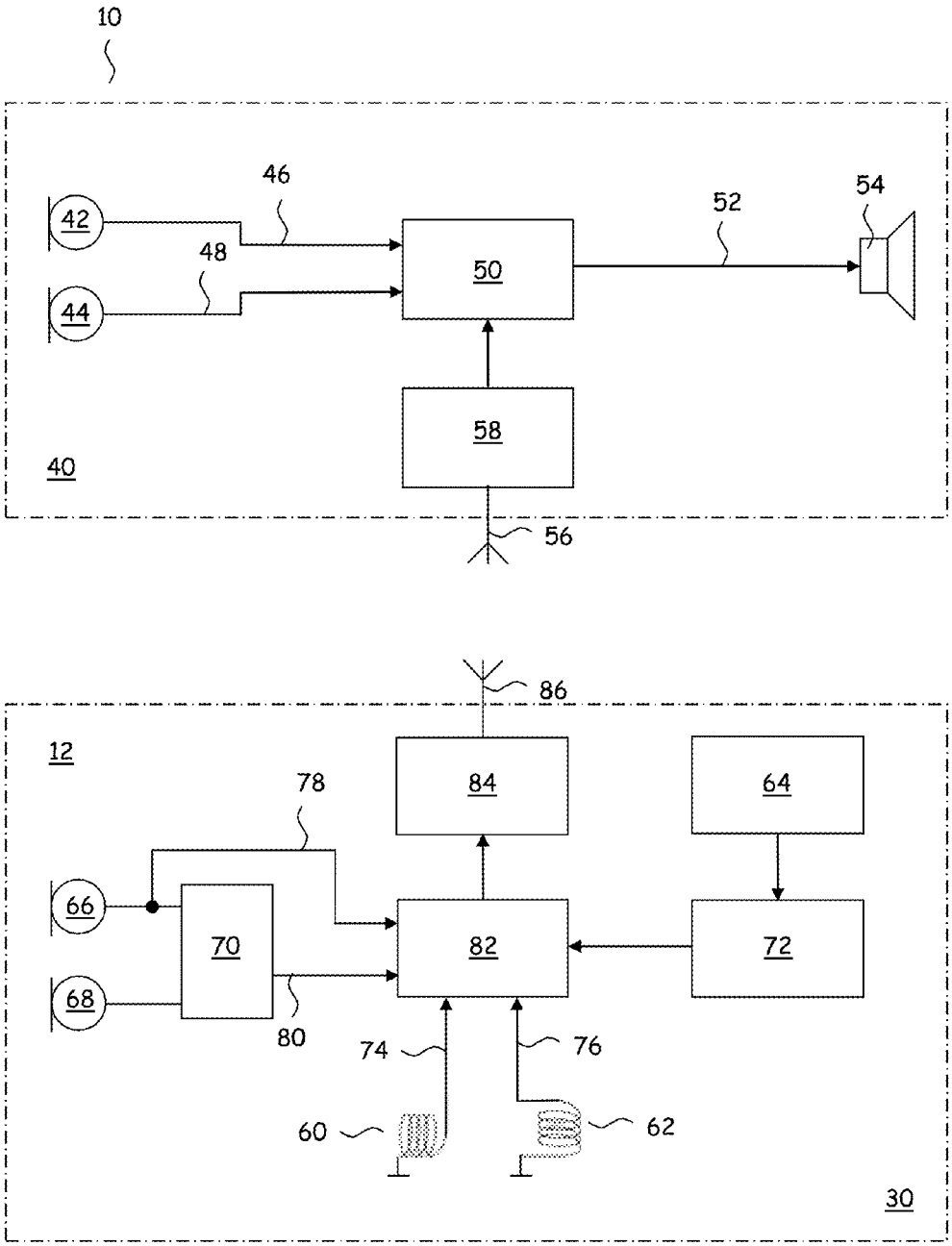
FIG. 3 is a blocked schematic of an example of the new hearing aid system.

FIG. 3 schematically illustrates exemplary circuitry of the new hearing aid system 10. The new hearing aid system 10 has a hearing aid 40 and an external input device 12. The hearing aid 40 may be of any suitable mechanical design, e.g. to be worn in the ear canal, or partly in the ear canal, behind the ear or in the concha, such as the well-known types: BTE, ITE, ITC, CIC, etc.

The illustrated hearing aid circuitry 40 comprises a front microphone 42 and optionally a rear microphone 44 for conversion of an acoustic sound signal from the surroundings into corresponding microphone audio signals 46, 48 output by the microphones 42, 44. The microphone audio signals 46, 48 are digitized in respective A/D converters (not shown) for conversion of the respective microphone audio signals 46, 48 into respective digital microphone audio signals 46, 48 that are optionally pre-filtered (pre-filters not shown) and selectively combined in signal processor 50 for selective formation of an audio signal with directivity as well as an omni-directional audio signal as is well-known in the art of hearing aids. The processor 50 is further configured to generate a hearing loss compensated output signal 52 that is input to a receiver 54 for conversion into acoustic sound for transmission towards an eardrum (not shown) of a user of the hearing aid system 10.

The illustrated hearing aid 40 is further configured to receive digital audio streamed from the external input device 12. The external input device 12 transmits digital audio wirelessly to the hearing aid 40 that receives the wireless digital audio by the antenna 56 connected to a radio receiver 58. The radio receiver 58 retrieves digital data from the received radio signal, including the digital audio. The digital audio may include audio from a plurality of sources and thus, the digital audio may form a plurality of input signals for the processor 50, one input signal for each source of audio. The audio sources may be mixed with the microphone audio signals 46, 48 in the processor 50 so that the user may simultaneously listen to one or more audio sources and sound from the surroundings.

The illustrated external input device 12 accommodates two telecoils 60, 62 inside the housing 14, one 62 of which has an orientation providing maximum reception sensitivity of a magnetic field emitted by an induction loop system, i.e. a so-called "hearing loop", when the external device 12 has a horizontal orientation, i.e. the top side 16 is substantially horizontal, and the other 60 of which has an orientation providing maximum reception sensitivity of a magnetic field emitted by an induction loop system, when the external device 12 has a vertical orientation, i.e. the top side 18 and the right and left sides 22, 24 are substantially vertical.

An orientation sensor 64, in the illustrated external input device 12 in the form of a three-axis accelerometer sensing gravity, accommodated in the housing 14 is configured for sensing orientation of the housing, and in particular configured for sensing when the external input device 12 is has a substantially horizontal orientation and a substantially vertical orientation, i.e. the three-axis accelerometer measures acceleration in three orthogonal directions and two of the orthogonal axes, in the following denoted the X-axis and the Y-axis, are aligned with gravity when the housing has the vertical (X-axis) and horizontal (Y-axis) orientation, respectively. With the housing 14 oriented vertically, the X-axis accelerometer measures plus or minus the acceleration of gravity g, while the Y-axis and Z-axis accelerometers measure zero acceleration. Likewise, with the housing 14 oriented horizontally, the Y-axis accelerometer measures plus or minus the acceleration of gravity g, while the X-axis and Z-axis accelerometers measure zero acceleration, and thus the first and second horizontal orientation, and the first and second horizontal orientation can easily be distinguished. The orientation of the housing may be determined within predetermined thresholds possibly with predetermined hysteresis. For example, when the orientation of the housing 14 is changed from horizontal, the selector may respond to changed orientation to vertical when the X-axis forms an angle less than 30° with a vertical line. Likewise, when the orientation of the housing 14 is changed from vertical, the selector may respond to changed orientation when the Y-axis forms an angle less than 30° with a horizontal line.

Acceleration determinations may be averaged in order to eliminate random variations, e.g. caused by body movements of the wearer of the external input device. High acceleration measurements, e.g. due to quick movements of the device, may be ignored.

The external input device 12 has two spaced apart omni-directional microphones 66, 68 with input ports 28, and a beamformer 70 configured for combining omni-directional microphone output signals of the at least two spaced apart microphones 66, 68 into a signal with a directional characteristic with a maximum direction of sensitivity pointing towards the rear side 20 and thus, towards the mouth of a speaker wearing the external input device in a vertical orientation with the horizontal rear side 20 facing upward.

A selector 72 accommodated in the housing 14 is configured for controlling the switch 82 to connect a selected one of the output signals 74, 76, 78, 80 of the telecoils 60, 62 and the microphones 66, 68 to the input 56 of the hearing aid 40 in response to the sensor signals of the three-axis accelerometer 64. In the illustrated external input device 12, the selector 72 is configured for selecting appropriate output signals in response to 4 distinct orientations of the external input device 12, namely 1) a first horizontal orientation in which the top side 16 with the microphone input ports 28 is substantially horizontal and facing upward, 2) a second horizontal orientation in which the top side 16 is substantially horizontal and facing downward, 3) a first vertical orientation in which the right and left sides 22, 24 are substantially vertical with the rear side 20 facing upward, and 4) a second vertical orientation in which the right and left sides 22, 24 are substantially vertical with the front side 18 facing upward.

In the first horizontal orientation, the selector controls the switch 82 to connect the microphone audio signal 78 with an omni-directional characteristic to the radio 84 for transmission via the antenna 86 to input 56 of the hearing aid 40.

In the second horizontal orientation, the selector controls the switch 82 to connect the output of the telecoil 62 with maximum reception sensitivity of a magnetic field from a hearing loop to the radio 84 for transmission via the antenna 86 to the input 56 of the hearing aid 40.

In the first vertical orientation, the selector controls the switch 82 to connect of the microphone audio signal 80 with the directional characteristic to the radio 84 for transmission via the antenna 86 to the input 56 of the hearing aid 40.

In the second vertical orientation, the selector controls connection of the output of the telecoil with maximum reception sensitivity of a magnetic field from a hearing loop to the radio 84 for transmission via the antenna 86 to the input 56 of the hearing aid 40.

Although particular embodiments have been shown and described, it will be understood that they are not intended to limit the claimed inventions, and it will be obvious to those skilled in the art that various changes and modifications may be made without departing from the spirit and scope of the claimed inventions. The specification and drawings are, accordingly, to be regarded in an illustrative rather than restrictive sense. The claimed inventions are intended to cover alternatives, modifications, and equivalents.

The invention claimed is:

1. A system comprising:

an external input device having at least one microphone and a housing accommodating at least two telecoils having different orientations with respect to the housing, and an orientation sensor configured for sensing an orientation of the housing; and a selector configured for selecting the at least one microphone as a signal source for a hearing aid when the external input device has a first orientation, and wherein the selector is configured for selecting a first telecoil of the at least two telecoils as the signal source for the hearing aid when the external input device has a second orientation.

2. The system according to claim 1, wherein the orientation sensor is selected from the group consisting of an accelerometer, a gyroscope, and a roll ball switch.

3. The system according to claim 1, wherein the selector is configured for selecting a second telecoil of the at least two telecoils as the signal source for the hearing aid when the external input device has a third orientation.

4. The system according to claim 3, further comprising a beam former for providing a directional microphone signal;

wherein the selector is configured for selecting the directional microphone signal for the hearing aid when the external input device has a fourth orientation.

5. The system according to claim 1, further comprising the hearing aid.

6. A method of communication with a hearing aid, comprising:

providing a plurality of telecoils with different orientations in a device for reception of a magnetic field;

providing an orientation sensor configured for sensing orientation of the device;

providing at least one microphone at the device;

selecting the at least one microphone as a signal source for a hearing aid when the device has a first orientation; and selecting one of the telecoils as the signal source for the hearing aid when the device has a second orientation.

* * * * *